US008731220B2

(12) United States Patent
Zhang et al.

(10) Patent No.: US 8,731,220 B2
(45) Date of Patent: May 20, 2014

(54) MEMS MICROPHONE

(75) Inventors: Rui Zhang, Shenzhen (CN); Lin-lin Wang, Shenzhen (CN); Zhou Ge, Shenzhen (CN); Xiao-lin Zhang, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 14 days.

(21) Appl. No.: 13/325,488

(22) Filed: Dec. 14, 2011

(65) Prior Publication Data

US 2012/0294464 A1 Nov. 22, 2012

(30) Foreign Application Priority Data

May 16, 2011 (CN) ..... 2011 1 0125517

(51) Int. Cl.
*H04R 25/00* (2006.01)

(52) U.S. Cl.
USPC ..... 381/174; 381/175

(58) Field of Classification Search
CPC .... H04R 19/04; H04R 19/016; H04R 19/005; H04R 23/006; B81B 2201/0257
USPC ..... 381/174, 175
See application file for complete search history.

(56) References Cited

U.S. PATENT DOCUMENTS

| | | | | |
|---|---|---|---|---|
| 4,311,881 | A * | 1/1982 | Reynard | 381/163 |
| 4,858,719 | A * | 8/1989 | Fidi et al. | 181/158 |
| 7,912,236 | B2 * | 3/2011 | Dehe et al. | 381/175 |
| 7,951,636 | B2 * | 5/2011 | Lee et al. | 438/53 |
| 7,974,430 | B2 * | 7/2011 | Izuchi et al. | 381/369 |
| 8,129,803 | B2 * | 3/2012 | Martin et al. | 257/415 |
| 2003/0123683 | A1 * | 7/2003 | Raicevich | 381/174 |
| 2006/0280319 | A1 * | 12/2006 | Wang et al. | 381/172 |
| 2007/0165888 | A1 * | 7/2007 | Weigold | 381/174 |
| 2007/0201710 | A1 * | 8/2007 | Suzuki et al. | 381/174 |
| 2008/0104825 | A1 * | 5/2008 | Dehe et al. | 29/594 |
| 2008/0304681 | A1 * | 12/2008 | Langlois et al. | 381/174 |
| 2009/0278217 | A1 * | 11/2009 | Laming et al. | 257/419 |
| 2010/0124343 | A1 * | 5/2010 | Zhang | 381/174 |
| 2010/0166235 | A1 * | 7/2010 | Zhang | 381/174 |
| 2010/0290648 | A1 * | 11/2010 | Zhang | 381/174 |
| 2011/0216922 | A1 * | 9/2011 | Li et al. | 381/174 |
| 2011/0235829 | A1 * | 9/2011 | Yang et al. | 381/174 |
| 2011/0241137 | A1 * | 10/2011 | Huang et al. | 257/419 |
| 2011/0255716 | A1 * | 10/2011 | Ge et al. | 381/174 |

* cited by examiner

*Primary Examiner* — Duc Nguyen
*Assistant Examiner* — Sean H Nguyen
(74) *Attorney, Agent, or Firm* — Anova Law Group, PLLC

(57) ABSTRACT

A MEMS microphone includes a silicon substrate, a diaphragm connected to the silicon substrate, a backplate opposed from the diaphragm for forming an air gap. The backplate defines a plurality of first through holes and a plurality of second through holes surrounded by the first through holes, each of the first through holes being formed by a straight boundary and an arc boundary, the radius of the second boundary being greater than half the width of the first boundary.

13 Claims, 4 Drawing Sheets

MEMS MICROPHONE

BACKGROUND OF THE INVENTION

1. Field of the Invention

The present disclosure relates to the art of microphones and, particularly to a MEMS microphone used in a portable device, such as a mobile phone.

2. Description of Related Arts

Miniaturized silicon microphones have been extensively developed for over sixteen years, since the first silicon piezoelectric microphone reported by Royer in 1983. In 1984, Hohm reported the first silicon electret-type microphone, made with a metallized polymer diaphragm and silicon backplate. And two years later, he reported the first silicon condenser microphone made entirely by silicon micro-machining technology. Since then a number of researchers have developed and published reports on miniaturized silicon condenser microphones of various structures and performance. U.S. Pat. No. 5,870,482 to Loeppert et al reveals a silicon microphone. U.S. Pat. No. 5,490,220 to Loeppert shows a condenser and microphone device. U.S. Patent Application Publication 2002/0067663 to Loeppert et al shows a miniature acoustic transducer. U.S. Pat. No. 6,088,463 to Rombach et al teaches a silicon condenser microphone process. U.S. Pat. No. 5,677,965 to Moret et al shows a capacitive transducer. U.S. Pat. Nos. 5,146,435 and 5,452,268 to Bernstein disclose acoustic transducers. U.S. Pat. No. 4,993,072 to Murphy reveals a shielded electret transducer.

Various microphone designs have been invented and conceptualized by using silicon micro-machining technology. Despite various structural configurations and materials, the silicon condenser microphone consists of four basic elements: a movable compliant diaphragm, a rigid and fixed backplate (which together form a variable air gap capacitor), a voltage bias source, and a pre-amplifier. These four elements fundamentally determine the performance of the condenser microphone. In pursuit of high performance; i.e., high sensitivity, low bias, low noise, and wide frequency range, the key design considerations are to have a large size of diaphragm and a large air gap. The former will help increase sensitivity as well as lower electrical noise, and the later will help reduce acoustic noise of the microphone. The large air gap requires a thick sacrificial layer. For releasing the sacrificial layer, the backplate is provided with a plurality of through holes. However, the through holes are unequally distributed in the backplate, which affects the releasing speed rate of the sacrificial layer and further affects the performance of the microphone.

Therefore, it is desirable to provide a MEMS microphone which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
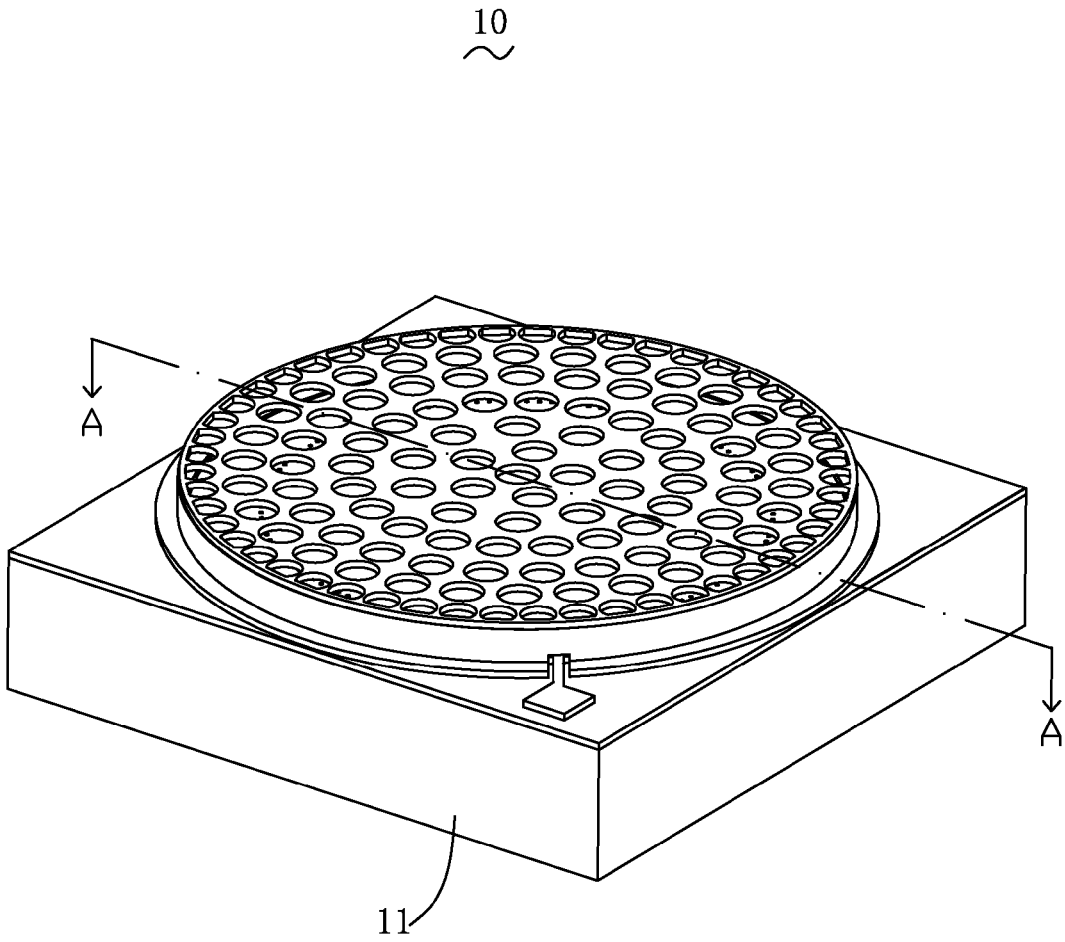
FIG. 1 is an isometric view of a micro-microphone in accordance with an exemplary embodiment of the present disclosure.
Figure 2:
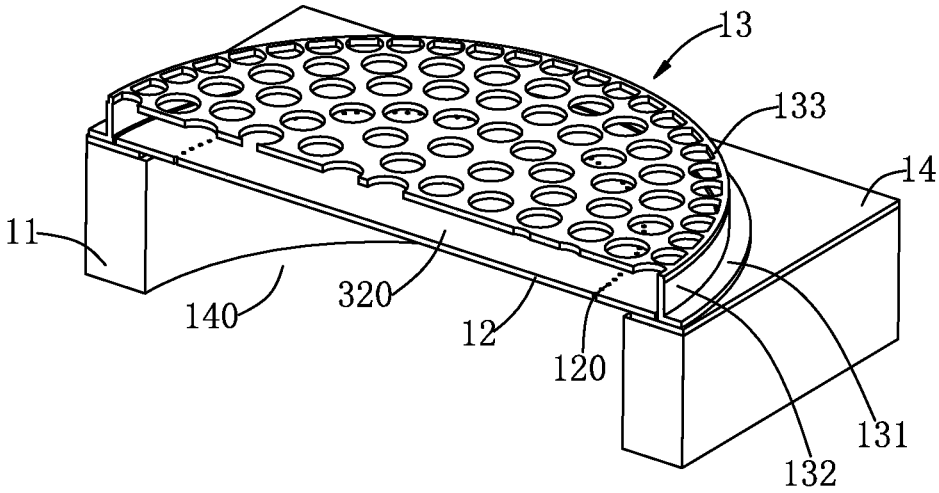
FIG. 2 is a cross-sectional view of the micro-microphone taken along line A-A in FIG. 1.

Referring to FIGS. 1 and 2, a MEMS microphone 10 includes a silicon substrate 11, a diaphragm 12 supported by the silicon substrate, and a backplate 13 opposite to the diaphragm 12. In the exemplary embodiment, the MEMS microphone 10 further defines a stopping layer 14 disposed on the silicon substrate 11. Both of the diaphragm 12 and the backplate 13 are anchored to the stopping layer 14. A cavity 140 is defined through the stopping layer 14 and the silicon substrate 11. For electrically separating the diaphragm 12 and the backplate 13, the diaphragm 12 is anchored to a relatively inner part of the stopping layer 14, and the backplate 13 is anchored to a relatively outer part of the stopping layer 14. The diaphragm 12 is insulated from the backplate 13 and comprises a plurality of leaking holes 120 therethrough. The backplate 13 defines a supporting part 131 anchored to the stopping layer 14, an extending part 132 extending upwardly from the supporting part 131, and a main part 133 extending from the extending part 132 and being opposite to the diaphragm 12. The main part 133 is opposite to the diaphragm 12 for forming an air gap 320 therebetween. The leaking holes 120 communicate the cavity 140 with the air gap 320.

Figure 3:
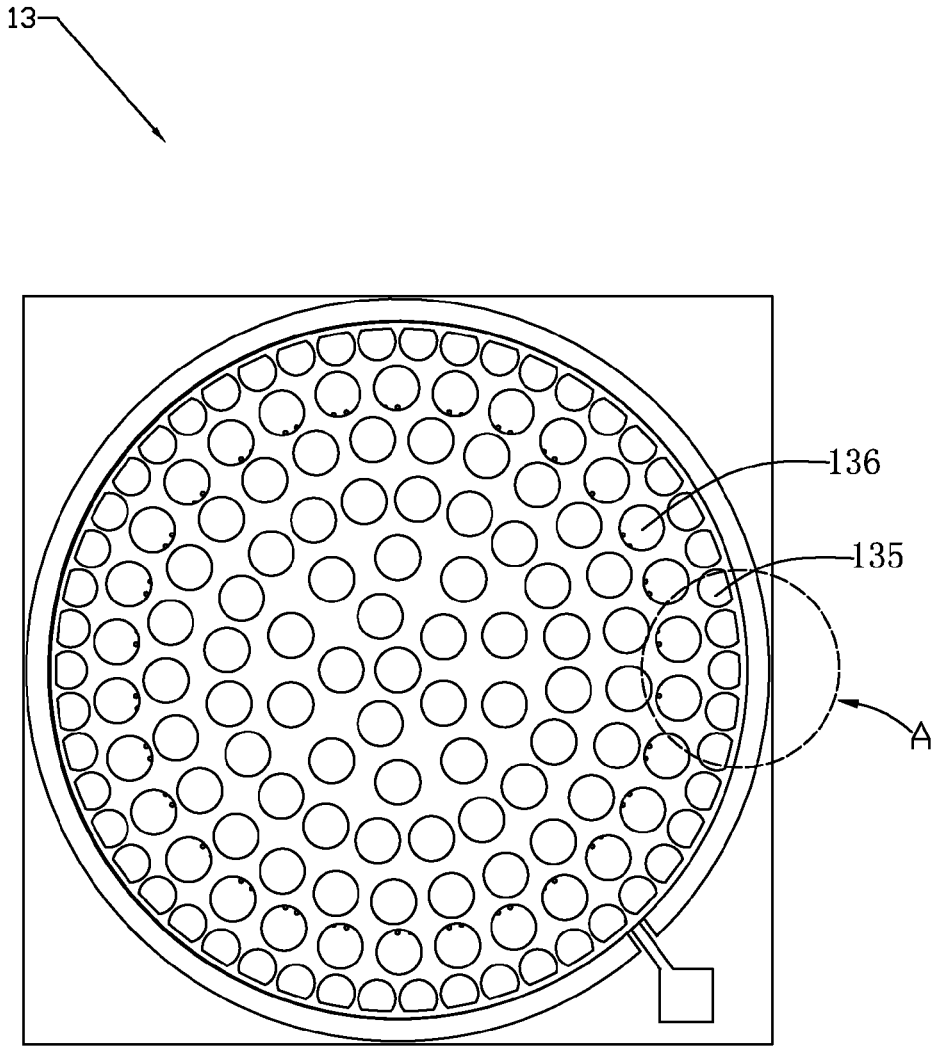
FIG. 3 is an illustration of a backplate of the MEMS microphone of the exemplary embodiment of the present disclosure.
Figure 4:
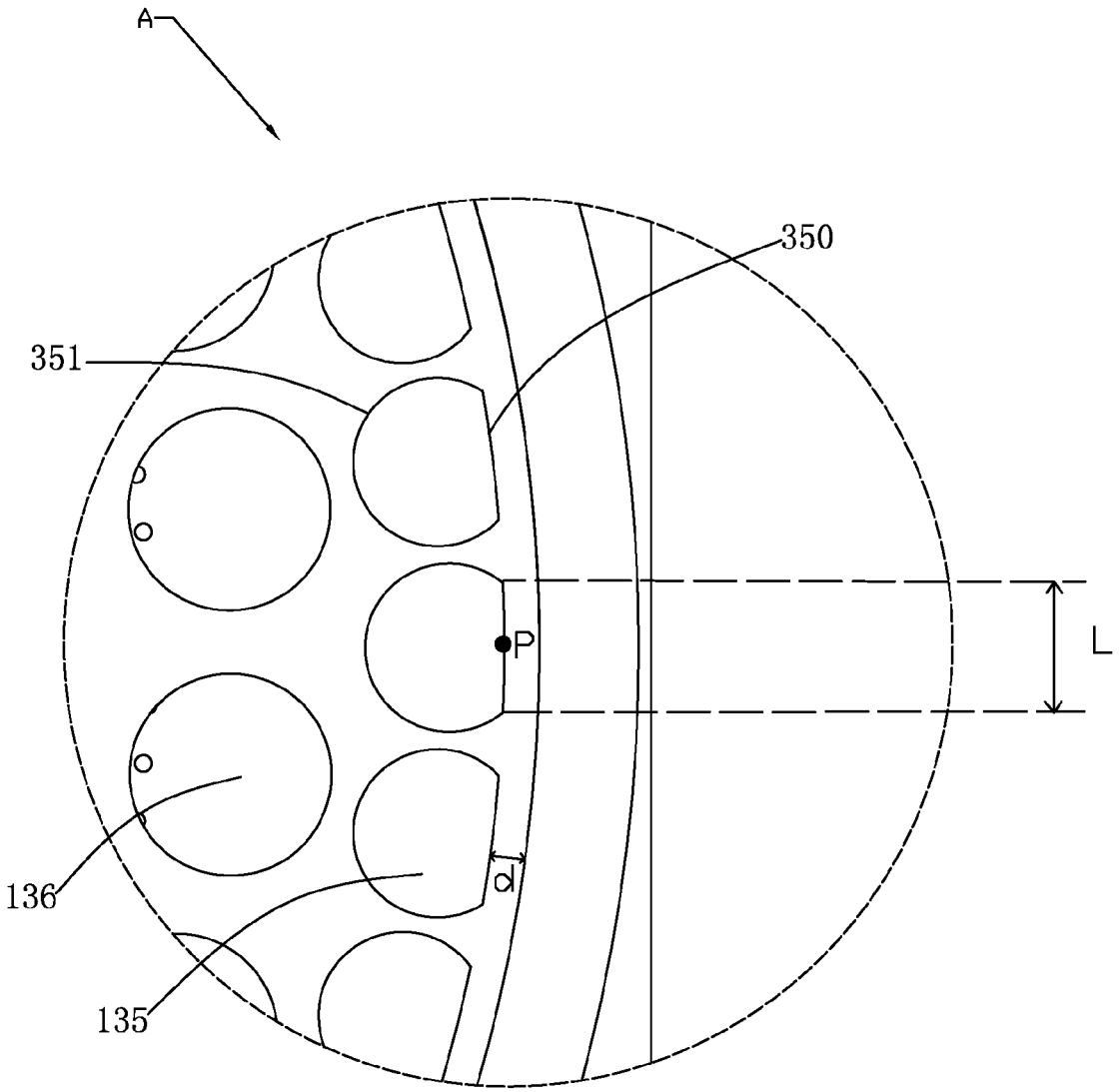
FIG. 4 is an enlarged view of Part B in FIG. 3.

Referring to FIGS. 3 and 4, the main part 133 of the backplate 13 comprises a plurality of first through holes 135 adjacent to the edge of the main part 133 and a plurality of second through holes 136 surrounded by the first through holes 135. The first through holes 135 are evenly distributed in the main part 133 with a constant distance between every two adjacent first through holes. Each of the first through holes 135 is same to the others. Further, a distance d is formed between each of the first through holes 135 and the edge of the main part 133.

The second through holes 136 are evenly distributed in the area surrounded by the first through holes 135.

Each of the first through holes 135 is formed by a first boundary 350 and a second boundary 351 with two ends thereof directly connecting two ends of the first boundary 350. The first boundary 350 is spaced from the edge of the main part 133 for forming the distance d. The first boundary 350 is configured to be straight and the second boundary 351 is configured to be an arc. The first boundary 350 defines a width L and includes a middle point P. A longest distance between the middle point P and the second boundary 351 is greater than half of the width L. Another word, the second boundary 351 has a radius greater than half of the width L. And another word, the width L of the first boundary 350 is smaller than the diameter of the second boundary 351.

By virtue of the configuration described above, the sacrificial layer near the edge of the backplate can be fully released through the through holes defined in the main part of the backplate, which effectively improves the performance of the MEMS microphone.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A MEMS microphone for converting mechanical vibration to electrical signals, comprising:

a silicon substrate defining a cavity;

a diaphragm connected to the silicon substrate;

a backplate connected to the silicon substrate, the backplate defining a main part facing and opposed from the diaphragm for forming an air gap; wherein the main part defines a plurality of through holes comprising a plurality of first through holes adjacent to the edge of the main part, and a plurality of second through holes surrounded by the first through holes, each of the first through holes being formed by a first boundary configured to be a straight line and a second boundary configured to be an arc, two ends of the arc directly connecting with two ends of the straight line.

2. The MEMS microphone as described in claim 1 further comprising a stopping layer supported by the silicon substrate for connecting the diaphragm and the backplate to the silicon substrate.

3. The MEMS microphone as described in claim 1, wherein the diaphragm further defines a plurality of leaking holes communicating the air gap with the cavity.

4. The MEMS microphone as described in claim 1, wherein the first boundary defines a width and includes a middle point, a longest distance between the middle point and the second boundary is greater than half of the width of the first boundary.

5. The MEMS microphone as described in claim 2, wherein the backplate further comprises a supporting part anchored to the stopping layer, and an extending part extending upwardly from the supporting part, and the main part extends from the extending part.

6. The MEMS microphone as described in claim 2, wherein the diaphragm is anchored to a relatively inner part of the stopping layer, and the backplate is anchored to a relatively outer part of the stopping layer.

7. A MEMS microphone comprising:

a silicon substrate;

a diaphragm connected to the silicon substrate;

a backplate opposed from the diaphragm for forming an air gap; wherein the backplate defines a plurality of first through holes forming a distance to an edge of the backplate, and a plurality of second through holes surrounded by the first through holes, each of the first through holes having a boundary consisting of a straight boundary and an arc boundary, two ends of the arc directly connecting with two ends of the straight line.

8. The MEMS microphone as described in claim 7 further comprising a stopping layer supported by the silicon substrate for connecting the diaphragm and the backplate to the silicon substrate.

9. The MEMS microphone as described in claim 7, wherein the diaphragm further defines a plurality of leaking holes communicating with the air gap.

10. The MEMS microphone as described in claim 7, wherein the straight boundary defines a width smaller than the diameter of the arc boundary.

11. The MEMS microphone as described in claim 8, wherein the backplate further comprises a supporting part anchored to the stopping layer, and an extending part extending upwardly from the supporting part, and the main part extends from the extending part.

12. The MEMS microphone as described in claim 8, wherein the diaphragm is anchored to a relatively inner part of the stopping layer, and the backplate is anchored to a relatively outer part of the stopping layer.

13. A MEMS microphone comprising:

a silicon substrate;

a diaphragm connected to the silicon substrate;

a backplate opposed from the diaphragm for forming an air gap; wherein the backplate defines a plurality of first through holes and a plurality of second through holes surrounded by the first through holes, each of the first through holes being formed by a straight boundary and an arc boundary directly connected with two ends of the straight boundary, the radius of the second boundary being greater than half the width of the first boundary.

* * * * *